United States Patent [19]

Rohr et al.

[11] Patent Number: 4,754,722

[45] Date of Patent: Jul. 5, 1988

[54] THREAD BREAK DETECTOR FOR A SEWING MACHINE

[75] Inventors: Gunter Rohr, Hemmingen; Wolfgang Norz, Schwieberdigen, both of Fed. Rep. of Germany

[73] Assignee: Union Special G.m.b.H., Stuttgart, Fed. Rep. of Germany

[21] Appl. No.: 65,221

[22] Filed: Jun. 22, 1987

[30] Foreign Application Priority Data

Jul. 31, 1986 [DE] Fed. Rep. of Germany ..... 3625963

[51] Int. Cl.[4] ..... D05B 69/36

[52] U.S. Cl. ..... 112/278; 250/561

[58] Field of Search ..... 112/273, 278; 66/163; 139/370.2; 250/559, 561

[56] References Cited

U.S. PATENT DOCUMENTS 4,284,020 8/1981 Conner, Jr. et al. ..... 112/273

4,426,948 1/1984 Olasz et al. ..... 112/278 X 4,691,647 9/1987 Von Stein ..... 112/273 X

FOREIGN PATENT DOCUMENTS 3431832 3/1986 Fed. Rep. of Germany ..... 112/278

*Primary Examiner*—Peter Nerbun

*Attorney, Agent, or Firm*—Powell L. Sprunger

[57] ABSTRACT

A thread break detector for a thread in a sewing machine comprising, a sensor device having a signal path cross section for scanning, a first thread guide disposed on one side of the sensor device, and a second thread guide disposed on the other side of the sensor device and being movable in synchronism with the stitch formation of the sewing machine, such that the second thread guide deflects the thread in the region of the sensor device a greater amount than the cross section of the sensor device signal path.

9 Claims, 2 Drawing Sheets

THREAD BREAK DETECTOR FOR A SEWING MACHINE

BACKGROUND OF THE INVENTION

The present invention relates to a thread break detector for a sewing machine.

It is known to use thread break detectors in sewing machines to monitor the sewing threads. Such thread break detectors are known from, for example, West German Patent Specification No. 35 01 387 and East German Patent Specification No. 228 843. West German Patent Specification No. 35 01 387 describes a thread break detector which monitors a plurality of sewing threads, and in which it is not possible to monitor one single sewing thread. Furthermore, the sewing threads are guided through a sensing arm, and are additionally deflected. East German Specificiation No. 228 843 relates to a contactless thread break detector in which the thread oscillations generated during the sewing operation are used as signal generators. As sewing threads of different materials and varying elasticity are used for sewing, and the oscillation amplitude of the sewing thread is dependent on the thread material and elasticity and on the sewing speed, it is not possible to transmit an unambiguous signal.

SUMMARY OF THE INVENTION

A principal feature of the present invention is the provision of an improved thread break detector for a sewing machine.

The thread break detector of the present invention comprises, a sensor device having a signal path cross section for scanning, a first thread guide disposed on one side of the sensor device, and a second thread guide disposed on the other side of the sensor device.

A feature of the present invention is that the second thread guide is movable in synchronism with the stitch formation of the sewing machine.

Another feature of the invention is that the second thread guide deflects the thread in the region of the sensor device a greater amount than the cross section of the sensor device signal path.

Yet another feature of the invention is that no movable scanning part is required in the detector.

A further feature of the invention is that an unambiguous signal is transmitted by the sensor.

A feature of the invention is that the first thread guide is adjustable.

Another feature of the invention is that the second thread guide is disposed in a stitch formation area of the sewing machine.

Further features will become more fully apparent in the following description of the embodiments of this invention and from the appended claims.

DESCRIPTION OF THE PREFERRED EMBODIMENTS

Figure 1:
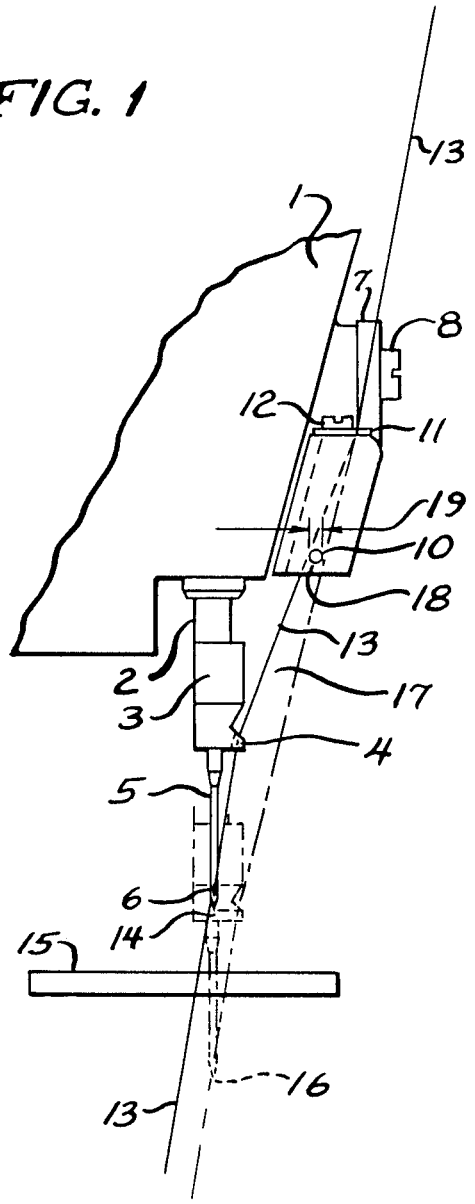
FIG. 1 is a side view of a thread break detector of the invention having a movable thread guide with the needle in the raised and lowered positions.
Figure 2:
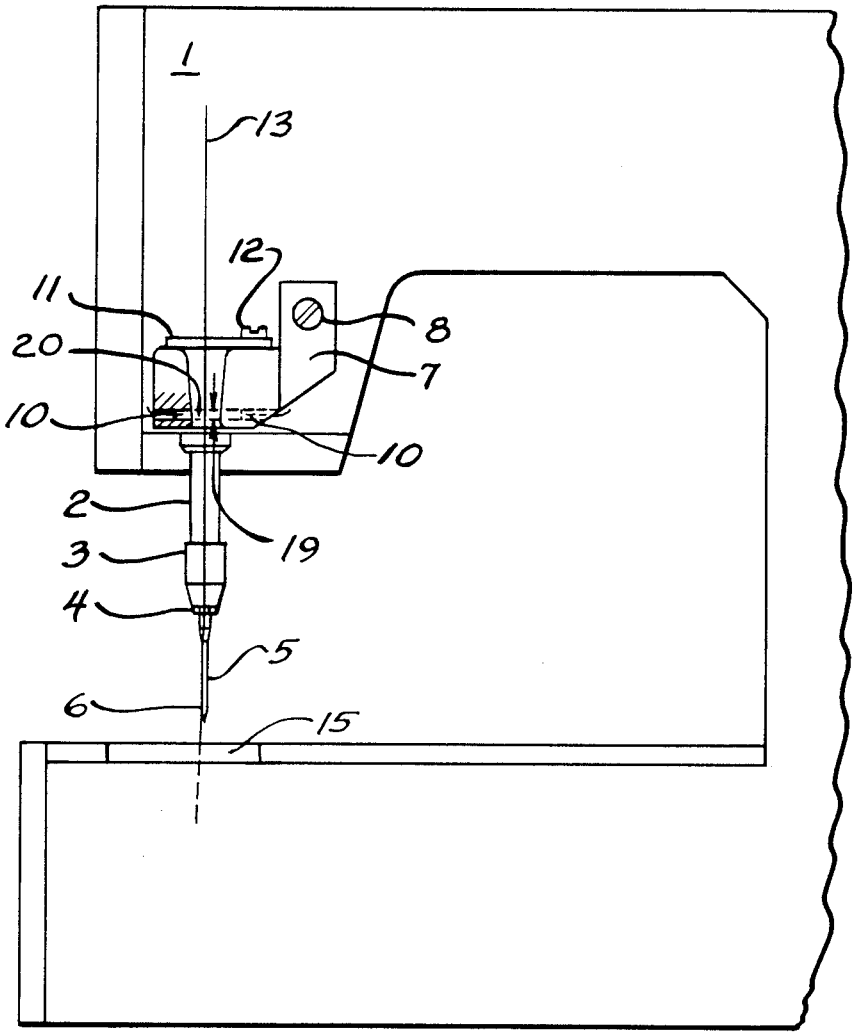
FIG. 2 is a front view of the thread break detector.

Referring now to FIGS. 1 and 2, a needle bar 2, to which a needle head 3 and a thread guide 4 are fastened, is mounted conventionally in a sewing machine housing

1. The needle head 3 serves to accommodate the needle 5 and needle eye 6. A sensor holder 7 is secured to the sewing machine housing 1 by a screw 8. The sensor holder 7 accommodates a sensor device 10, which is connected to a known control device which is not shown in the drawings. An adjustable thread guide 11 is fastened by a screw 12 to the sensor holder 7. The sewing thread is guided through the thread guides 11, 4 and the needle eye 6.

When the needle 5 is in the raised position 14, it is above the needle plate 15. When it is in the lowered position 16, the needle 5 extends into the needle plate 15.

As sewing thread 13 is used up during the sewing operation and, for secure stitch formation, the sewing thread is tensioned and monitored during the sewing operation by known thread guides and thread braking means (not shown), a thread angle region 17 is compulsorily formed between the thread guide 11 and the movable thread guide 4 when the thread guide 4 moves from the needle-raised position 14 into the needle-lowered position 16, and vice versa.

Between the sides of the thread angle region 17, starting from the thread guide 11, a thread deflection 18 takes place in the region of the sensor device 10, which deflection is greater than the cross section 19 of the effective sensor signal path 20 of the sensor device 10 required for scanning.

When the thread breaks, it loses its tension and becomes uncontrolled, or is missing between the thread guides 4 and 11, and hence does not transmit a signal to the sensor device in synchronism with the stitch formation.

The example in the drawings shows a needle thread on a sewing machine. The disclosed thread break detector is also suitable for a looper thread on a chain stitch sewing machine. In this case, the deflection of a looper thread, which takes place in synchronism with the stitch formation, between a movable part, for example the chain stitch looper, and a thread guide mounted in front of the movable part, is used as the signal generator. If the looper thread breaks, the signal which is required for monitoring the thread and whose presence renders it possible for the sewing machine to be driven during the sewing operation, fails. If the signal fails, the machine is brought to a stop during the sewing operation.

The foregoing detailed description is given for clearness of understanding only, and no unnecessary limitations should be understood therefrom, as modifications will be obvious to those skilled in the art.

What is claimed is:

1. A thread break detector for sewing machines, which monitors the sewing thread between two thread guides by means of a sensor device, characterized in that a thread guide is disposed such that it moves in synchronism with the stitch formation, and the deflection of the sewing thread compelled by the movably disposed thread guide in the region of the sensor device is greater than the cross section of the signal path of the sensor device required for scanning, with the thread being directly monitored by the sensor device.

2. A thread break detector for sewing machines as claimed in claim 1, characterized in that one thread guide is adjustable.

3. A thread break detector for sewing machines as claimed in claim 1, characterized in that the movably disposed thread guide is part of a movable component disposed in the stitch formation area of the sewing machine.

4. A thread break detector as claimed in claim 2, characterized in that the movably disposed thread guide is part of a movable component disposed in the stitch formation area of the sewing machine.

5. A thread break detector for a thread in a sewing machine, comprising:

a sensor device having a signal path cross section for scanning;

a first thread guide disposed on one side of the sensor device; and a second thread guide disposed on the other side of the sensor device and being movable in synchronism with the stitch formation of the sewing machine, such that the second thread guide deflects the thread in the region of the sensor device a greater amount than said cross section of the sensor device signal path, with the thread being directly monitored by the sensor device.

6. The detector of claim 5 wherein the first thread guide is adjustable.

7. The detector of claim 5 wherein the second thread guide is disposed in a stitch formation area of the sewing machine.

8. A thread break detector for sewing machines, which monitors the sewing thread between two thread guides by means of a sensor device, characterized in that a thread guide is disposed such that it moves in synchronism with the stitch formation, and the deflection of the sewing thread compelled by the movably disposed thread guide in the region of the sensor device is greater than the cross section of the signal path of the sensor device required for scanning, characterized in that one thread guide is adjustable, and that the movably disposed thread guide is part of a movable component disposed in the stitch formation area of the sewing machine.

9. A thread break detector for a thread in a sewing machine comprising:

a sensor device having a signal path cross section for scanning;

a first thread guide disposed on one side of the sensor device; and a second thread guide on the other side of the sensor device and being movable in synchronism with the stitch formation of the sewing machine, such that the second thread guide deflects the thread in the region of the sensor device a greater amount than said cross section of the sensor device signal path, wherein the first thread guide is adjustable, and the movably disposed second guide is part of a movable component disposed in the stitch formation area of the sewing machine.

* * * * *